US011539121B2

(12) United States Patent
Cunningham

(10) Patent No.: US 11,539,121 B2
(45) Date of Patent: Dec. 27, 2022

(54) ANTENNA MOUNT

(71) Applicant: Neal Technologies, Inc., Mesa, AZ (US)

(72) Inventor: James B. Cunningham, Mesa, AZ (US)

(73) Assignee: Neal Technologies, Inc., Mesa, AZ (US)

( * ) Notice: Subject to any disclaimer, the term of this patent is extended or adjusted under 35 U.S.C. 154(b) by 0 days.

(21) Appl. No.: 17/500,586

(22) Filed: Oct. 13, 2021

(65) Prior Publication Data

US 2022/0123457 A1 Apr. 21, 2022

Related U.S. Application Data

(60) Provisional application No. 63/092,150, filed on Oct. 15, 2020.

(51) Int. Cl.
*H01Q 1/32* (2006.01)
*H01Q 1/12* (2006.01)

(52) U.S. Cl.
CPC ..... *H01Q 1/3275* (2013.01); *H01Q 1/1214* (2013.01)

(58) Field of Classification Search
CPC ..... H01Q 1/32; H01Q 1/325; H01Q 1/3275; H01Q 1/1214
See application file for complete search history.

(56) References Cited

U.S. PATENT DOCUMENTS 5,959,585 A * 9/1999 Militz ..... H01Q 1/3275 343/872
2006/0187621 A1* 8/2006 Noro ..... H01Q 1/42 361/600
2019/0020103 A1* 1/2019 Neal ..... H01Q 1/44

* cited by examiner

*Primary Examiner* — Robert Karacsony
(74) *Attorney, Agent, or Firm* — Hartman Titus PLC; John D. Titus

(57) ABSTRACT

An antenna adapter which can be mounted to the roof of a vehicle equipped with an Original Equipment Manufacturer (OEM) roof-mounted "shark fin" antenna comprises a spacer having a generally oblong body that is at least as large as the footprint of the OEM antenna with a mounting surface that extends beyond the footprint of the OEM antenna. The mounting surface is adapted to receive an antenna base while the underside of the adapter includes an oblong recess for routing an antenna cable from the antenna base to the interior of the vehicle. The adapter is mounted to the vehicle roof using a threaded fastener that is longer than the OEM fastener. The adapter is sandwiched between the OEM antenna and the vehicle roof to provide a leakproof seal.

7 Claims, 4 Drawing Sheets

ANTENNA MOUNT

BACKGROUND OF THE INVENTION

This invention relates generally to automobile equipment and, in particular to automobile antennas.

Prior art means for attaching an auxiliary communications antenna (CB radio, Satellite, etc.) to a vehicle consist of a magnetic base, clamp or similar temporary mount, which requires the coaxial cable from the radio to the antenna to be routed through the vehicle door or window to the antenna. This often leads to wind noise and/or water leakage through the door or window seal. Moreover, the ubiquitous temporary magnetic base antenna mount is becoming less and less universal as a result of the increasing use of non-ferromagnetic materials such aluminum and carbon fiber composites in vehicle construction. Permanent non-magnetic antenna installations require modification of (e.g. drilling holes in) the vehicle, which can also lead to water leakage if not done correctly, and requires irreversible modifications to the vehicle, which can reduce resale value.

SUMMARY OF THE INVENTION

The present invention comprises an antenna adapter which can be mounted to the roof of a vehicle equipped with an Original Equipment Manufacturer (OEM) roof-mounted "shark fin" antenna. According to an illustrative embodiment, the adapter comprises a spacer having a generally oblong body that matches the side walls of the OEM antenna but extends forward of the OEM antenna. The adapter has a mounting aperture that aligns with the mounting boss of the OEM antenna. In the illustrative embodiment, the forward end of the adapter has an aperture for mounting a New Motorola (NMO) mount. The underside of the adapter includes an oblong recess for routing an antenna cable from the NMO mount through the vehicle roof. The adapter is mounted to the vehicle roof using a threaded fastener that is longer than the OEM fastener. The fastener is tightened so that the adapter is sandwiched between the OEM antenna and the vehicle roof to provide a leakproof seal.

BRIEF DESCRIPTION OF THE DRAWING

The present invention will be better understood from a reading of the following detailed description, taken in conjunction with the accompanying drawing figures in which like references designate like elements and, in which.

DETAILED DESCRIPTION

Figure 1:
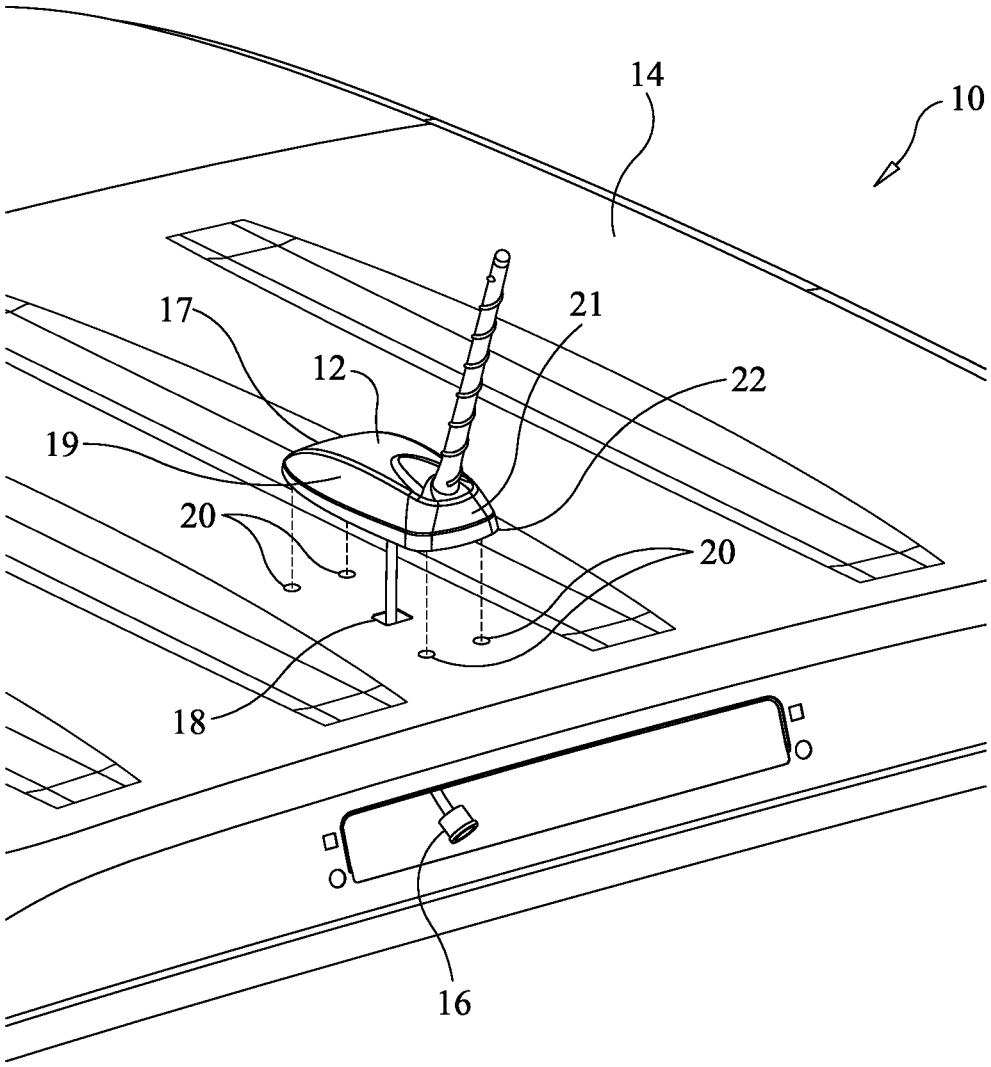
FIG. 1 PRIOR ART
FIG. 1 is an exploded perspective view of a vehicle having a prior art OEM shark fin antenna.

The drawing figures are intended to illustrate the general manner of construction and are not necessarily to scale. In the detailed description and in the drawing figures, specific illustrative examples are shown and herein described in detail. It should be understood, however, that the drawing figures and detailed description are not intended to limit the invention to the particular form disclosed, but are merely illustrative and intended to teach one of ordinary skill how to make and/or use the invention claimed herein and for setting forth the best mode for carrying out the invention.

With reference to the drawing figures and, in particular FIG. 1, a vehicle 10 is shown with a prior art Original Equipment Manufacturer (OEM) antenna 12, sometimes referred to as a "shark fin" antenna, mounted to the roof 14 of vehicle 10. Typically, the OEM antenna has an electrical cable 16 which passes downward through a cable aperture 18 in the roof 14 of the vehicle 10. A fastener is then used to attach the OEM antenna 12 to the vehicle. In some applications, such as a 2015 Chevrolet Colorado, the single fastener is a bolt that threads into the OEM antenna 12 through cable aperture 18 from inside the cabin. A stand-off with at least one slot is placed between the bolt and the vehicle roof to provide an exit path for electrical cable 16 inside the vehicle cabin. In other applications, such as a 2012 Toyota Tacoma, the OEM antenna 12 has a stud with a passageway. The electrical cable is inserted into the passageway in the stud where the stud passes through cable aperture 18. A nut is threaded onto the stud from inside the cabin to hold the OEM antenna in place. In some applications, secondary apertures 20 are provided to give additional support to the OEM antenna with additional fasteners threaded through secondary apertures 20. The OEM antenna 12 has a perimeter surface 15 defined by a forward wall 17, a pair of lateral walls 19 and a rearward wall 21. The OEM antenna 12 further has a footprint 22, which is defined by the portion of the perimeter surface 15 that is in contact with the roof of the vehicle when the OEM antenna 12 is installed.

Figure 2:
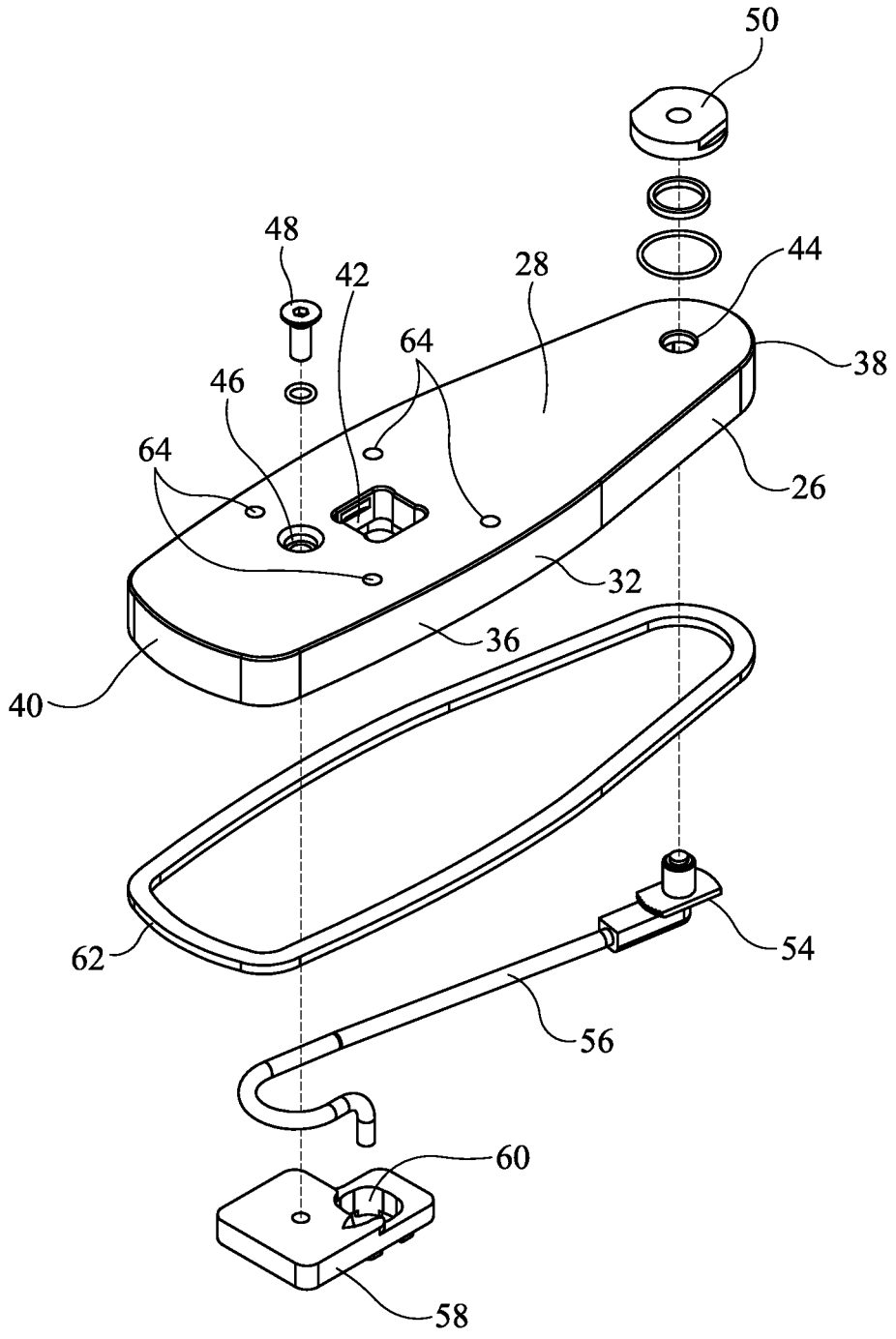
FIG. 2 is an exploded top perspective view of an antenna adapter incorporating features of the present invention.
Figure 3:
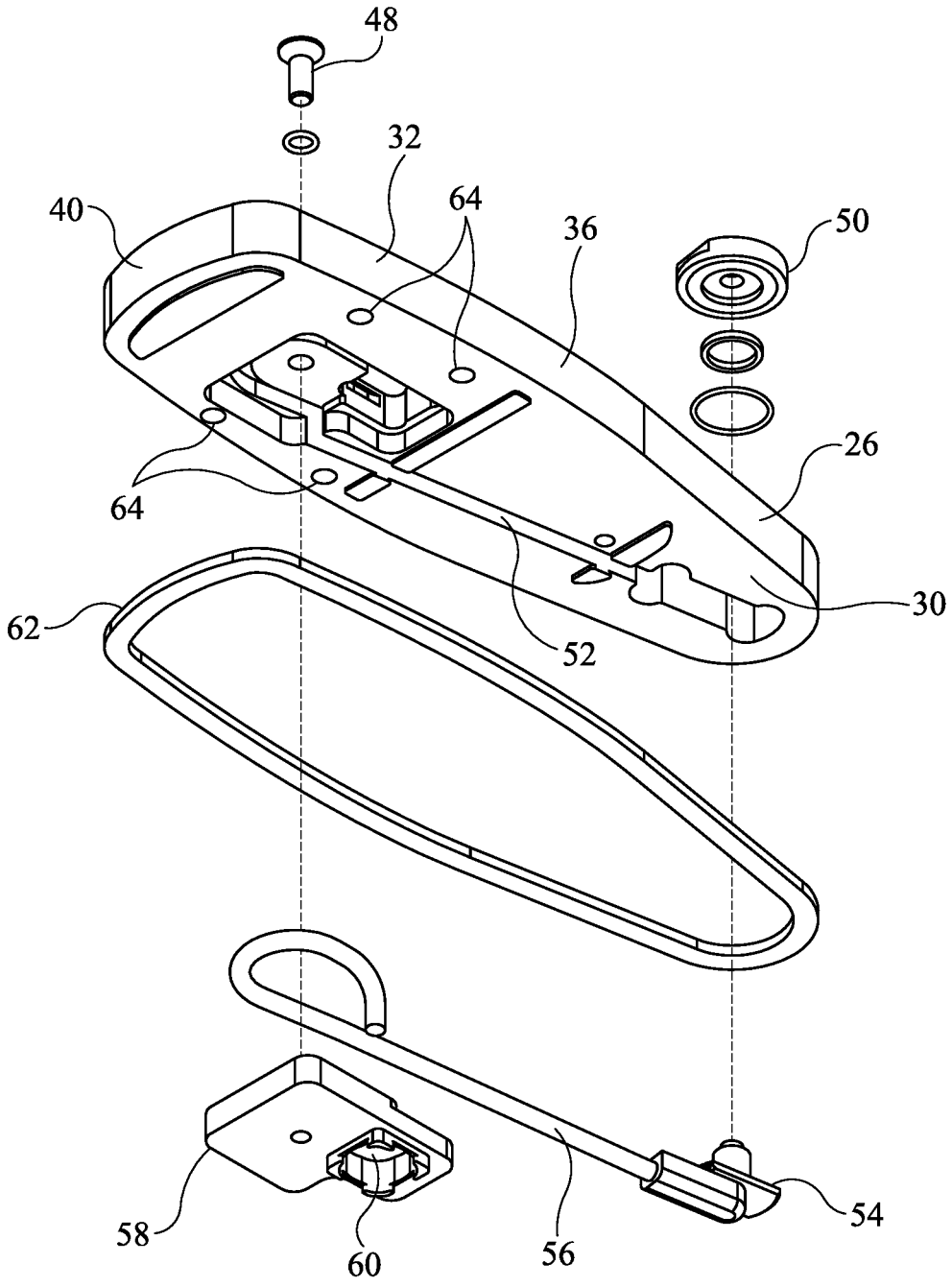
FIG. 3 is an exploded bottom perspective view of the antenna adapter of FIG. 2.

With additional reference to FIGS. 2-3, an antenna adapter 24 incorporating features of the present invention comprises a spacer 26, having an upper surface 28, a lower surface 30 and a peripheral surface 32. Spacer 26 further includes a main aperture 42 that is the same size and shape as cable aperture 18, which extends through spacer 26 from upper surface 28 to lower surface 30. Peripheral surface 32 comprises side walls 34, 36 joined by a curvilinear front wall 38 and a curvilinear rear wall 40. Peripheral surface 32 is preferably at least as large as footprint 22 of OEM antenna so that it covers completely any mounting apertures for OEM antenna 12. Side walls 34, 36 are preferably contoured to match that portion of footprint 22 of OEM antenna 12 where OEM antenna 12 is in contact with spacer 26 so that there is a smooth transition from OEM antenna 12 to antenna adapter 24. In the illustrative embodiment, side walls 34, 36 and rear wall 40 match footprint 22, however, front wall 38 extends beyond footprint 22 to provide a space forward of OEM antenna 12 for mounting antenna base assembly 50 discussed hereinafter. An antenna mounting hole 44, and a hole 46 for assembly screw 48 also extend through spacer 26. Mounting hole 44 receives an antenna base assembly 50, which in the illustrative embodiment comprises an NMO model MABT8PI: 3/8 Thru-Hole NMO Mount from Arcadian, Inc. 826 Bloomfield Ave, Verona N.J. 07044.

With particular reference to FIG. 3, lower surface 30 of spacer 26 includes an oblong recess 52 which is sized and shaped to accommodate a 90-degree transition piece 54 and to route cable 56 from 90-degree transition piece 54 to main aperture 42 of spacer 26 with everything fully within recess 52 so that spacer 26 can be mounted flat onto roof 14. Assembly bracket 58 retains cable 56 and provides an aperture 60 for cable 56 and electrical cable 16 to pass into the interior of the vehicle cabin while preventing cable 56 from chafing against the sheet metal opening of cable aperture 18. A gasket 62 is provided to form a leak-proof seal between spacer 26 and roof 14. Upper surface 28 of spacer 26 is preferably sized and shaped to match the gasket of OEM antenna 12 so that when OEM antenna 12 is mounted to antenna adapter 24 the OEM gasket will provide a leakproof seal. Additional mounting holes 64 may be provided where the OEM antenna 12 has additional mounting hardware.

Figure 4:
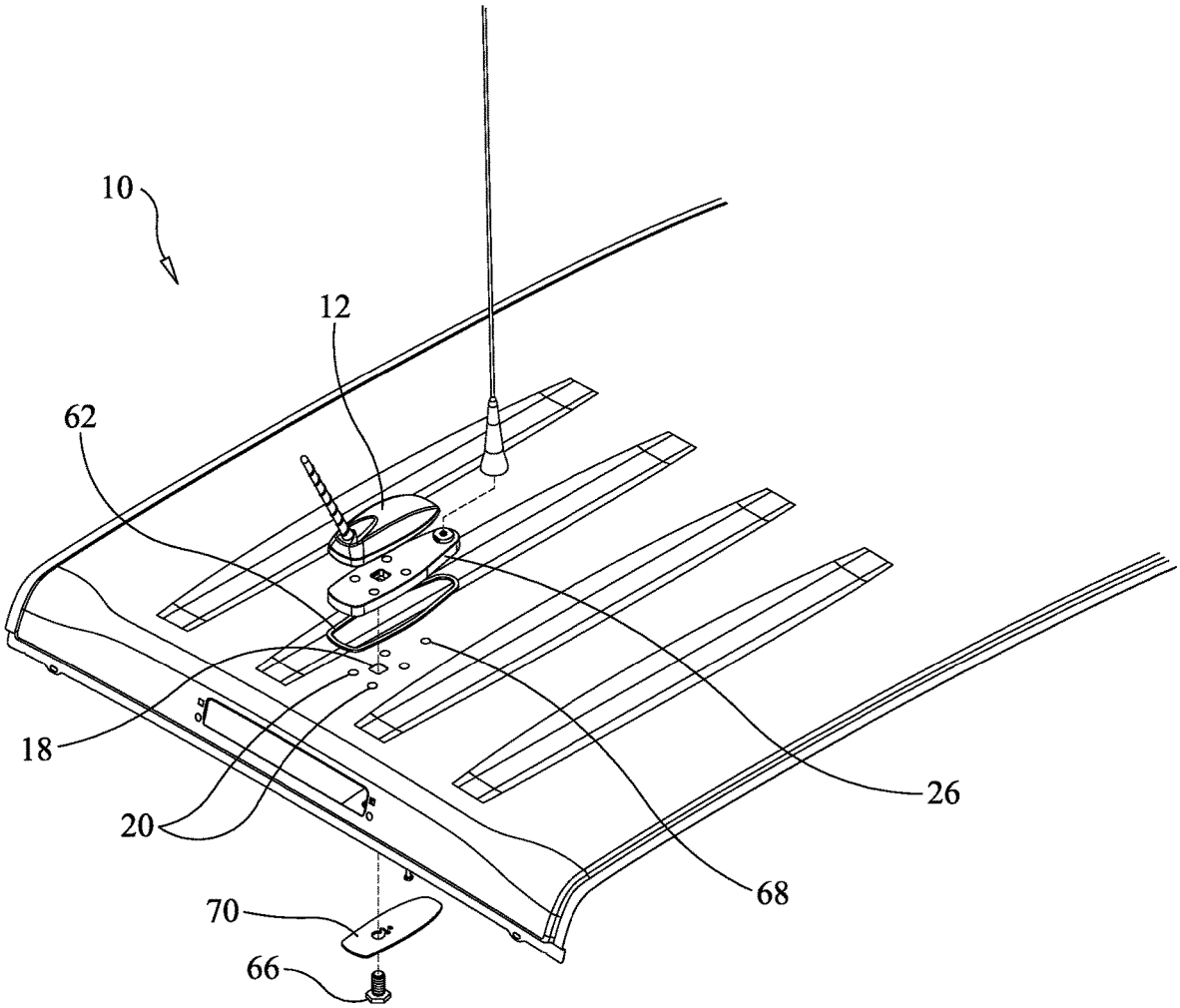
FIG. 4 is a perspective view of the antenna adapter of FIG. 2 installed on a vehicle.

With additional reference to FIG. 4, antenna adapter 24 is assembled to roof 14 of vehicle using the OEM antenna 12 as a clamp with antenna adapter 24 sandwiched between OEM antenna 12 and roof 14. To accomplish this, a threaded fastener 66 is used. Threaded fastener 66 is similar to the OEM mounting hardware, but is modified to accommodate the thickness of spacer 26. For vehicles using a bolt, like the Chevrolet Colorado, a longer bolt is used. For vehicles with a stud-mounted OEM antenna, a barrel nut with an extended reach is used. A support bracket 70 is interposed between threaded fastener and roof 14. Support bracket 70 includes a T-shaped aperture that aligns at least partially with cable aperture 18 so that electrical cable 16 and cable 56 can be routed to the interior of vehicle 10. Other assembly methods may be incorporated depending on the OEM configuration. In some cases, it will be necessary to add an additional mounting aperture 68 to support antenna adapter 24. This is permissible as long as additional mounting aperture 68 is still within footprint 22 so that if antenna adapter 24 is ever removed, additional mounting aperture 68 will be concealed by OEM antenna 12.

Although certain illustrative embodiments and methods have been disclosed herein, it will be apparent from the foregoing disclosure to those skilled in the art that variations and modifications of such embodiments and methods may be made without departing from the invention. For example, although in the illustrative embodiment spacer 26 extends forward of OEM antenna 12, spacer 26 could instead extent rearward of OEM antenna 12 without departing from the scope of the invention. Accordingly, it is intended that the invention should be limited only to the extent required by the appended claims and the rules and principles of applicable law. Additionally, as used herein, references to direction such as "up" or "down" as well as recited materials or methods of attachment are intended to be exemplary and are not considered as limiting the invention and, unless otherwise specifically defined, the terms "generally," "substantially," or "approximately" when used with mathematical concepts or measurements mean within ±10 degrees of angle or within 10 percent of the measurement, whichever is greater. As used herein, a step of "providing" a structural element recited in a method claim means and includes obtaining, fabricating, purchasing, acquiring or otherwise gaining access to the structural element for performing the steps of the method. As used herein, the claim terms are to be given their broadest reasonable meaning unless a clear disavowal of that meaning appears in the record in substantially the following form ("As used herein the term _____ is defined to mean _____")

What is claimed is:

1. An antenna adapter for attaching a communications antenna to a vehicle equipped with an original equipment roof-mounted antenna, the original equipment roof-mounted antenna having a footprint defined by a forward wall, a rearward wall and a plurality of lateral walls, the original equipment roof-mounted antenna having an electrical cable passing through an original equipment cable aperture in the vehicle roof, the antenna adapter comprising:

a spacer comprising a generally oblong body having an upper surface, a lower surface and a peripheral surface, the peripheral surface comprising a front wall and a rear wall joined by a plurality side walls, the peripheral surface being at least as large as the footprint of the original equipment roof-mounted antenna, the upper surface of the spacer having a mounting surface extending outward beyond the footprint of the original equipment roof-mounted antenna;

the mounting surface of the spacer adapted to receive an antenna mount, the spacer further comprising an oblong recess for receiving an antenna cable passing from the antenna mount to the vehicle interior, the spacer further comprising at least one through-hole that communicates with the original equipment cable aperture in the vehicle roof; and a support bracket, the support bracket comprising a solid body having at least one aperture aligning with the original equipment cable aperture in the vehicle roof.

2. The antenna adapter of claim 1, wherein:

the mounting surface of the spacer extends forward beyond the footprint of the original equipment roof-mounted antenna.

3. The antenna adapter of claim 1, wherein:

the at least one through-hole that communicates with the original equipment cable aperture in the vehicle roof comprises a through-hole that aligns with the original equipment cable aperture.

4. The antenna adapter of claim 1, wherein:

the oblong recess for receiving an antenna cable passing from the antenna mount to the existing original equipment cable aperture comprises a recess in the lower surface of the spacer.

5. The antenna adapter of claim 1, wherein:

the plurality side walls of the spacer align with the plurality of lateral walls of the original equipment roof-mounted antenna in a region where the original equipment roof-mounted antenna is in contact with the spacer.

6. The antenna adapter of claim 1, further comprising:

a fastener, the fastener attaching to the original equipment roof-mounted antenna through the original equipment cable aperture in the vehicle roof, whereby the spacer is sandwiched between the original equipment roof-mounted antenna and the vehicle roof.

7. The antenna adapter of claim 1, further comprising:

a fastener, the fastener attaching to the original equipment roof-mounted antenna through a secondary aperture in the vehicle roof, whereby the spacer is sandwiched between the original equipment roof-mounted antenna and the vehicle roof.

* * * * *